US005375733A

United States Patent [19]

Kohler et al.

[11] Patent Number: 5,375,733

[45] Date of Patent: Dec. 27, 1994

[54] CORNER LOCK FOR LINING TANK BOTTOMS

[75] Inventors: Howard L. Kohler, Bakersfield, Calif.; Daniel D. North, Aurora; Billy R. Balcomb, Minooka, both of Ill.

[73] Assignee: Chicago Bridge & Iron Technical Services Company, Oak Brook, Ill.

[21] Appl. No.: 105,002

[22] Filed: Aug. 11, 1993

[51] Int. Cl.[5] ..... B65D 7/00

[52] U.S. Cl. ..... 220/461; 220/404

[58] Field of Search ..... 220/461, 403, 404, 430, 220/470, 565, 4.12

[56] References Cited

U.S. PATENT DOCUMENTS

| | | | |
|---|---|---|---|
| 2,321,777 | 6/1943 | Schelhammer et al. | 220/461 X |
| 2,989,757 | 6/1961 | Friedlander et al. | 220/461 |
| 3,268,917 | 8/1966 | Diemond et al. | 220/404 X |
| 3,460,705 | 8/1969 | Green | 220/404 |
| 4,068,777 | 1/1978 | Humphrey et al. | 220/1 B |
| 4,860,916 | 8/1989 | Winters | 220/404 |

OTHER PUBLICATIONS

"Intsallation of Polylock TM", SLT ® North America (as submitted by Applicant on May 18, 1994)–Note Attached qualification.

"Welded Steel Tanks for Oil Storage," Manufacturing, Distribution and Marketing Department, API Standard 650, Ninth Edition, Jul. 1993.

*Primary Examiner*—Steven M. Pollard

*Attorney, Agent, or Firm*—Marshall, O'Toole, Gerstein, Murray & Borun

[57] ABSTRACT

A tank seal in accordance with the present invention includes a flexible sheet having a horizontal portion bearing on a tank bottom and a vertical portion extending upwardly from the horizontal portion adjacent the shell of the tank, and the seal includes a rim fixed to the flexible sheet for engaging the seal to the tank shell.

16 Claims, 2 Drawing Sheets

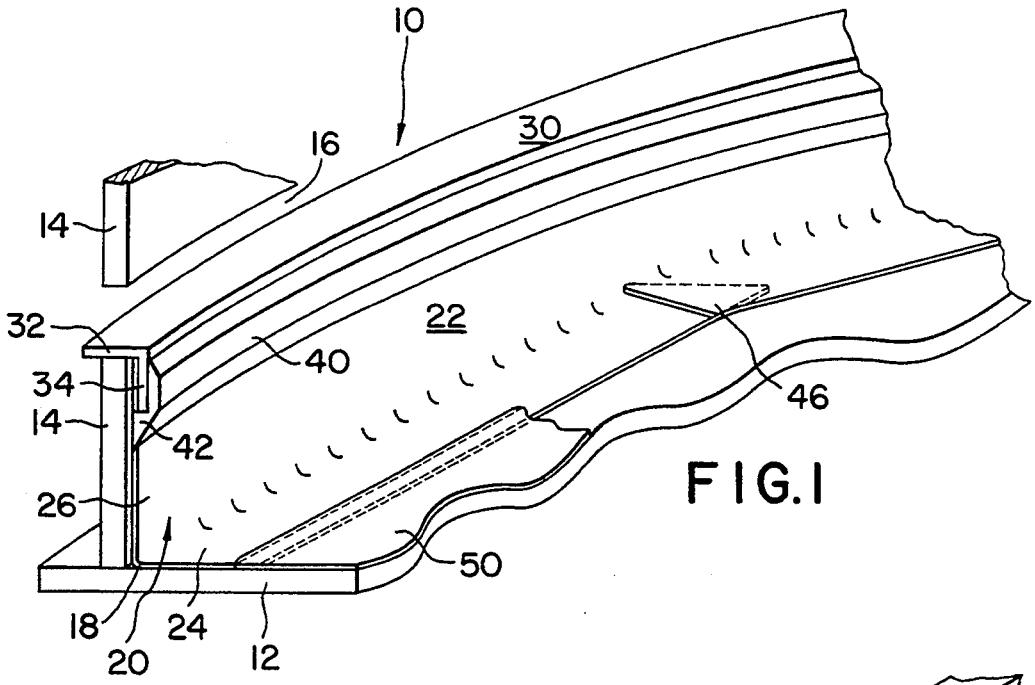
FIG.1
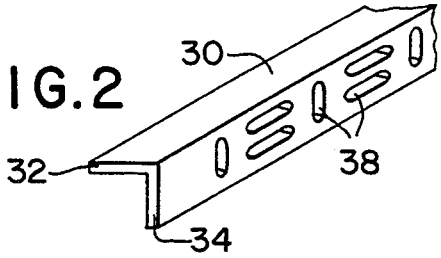
FIG.2
FIG.3
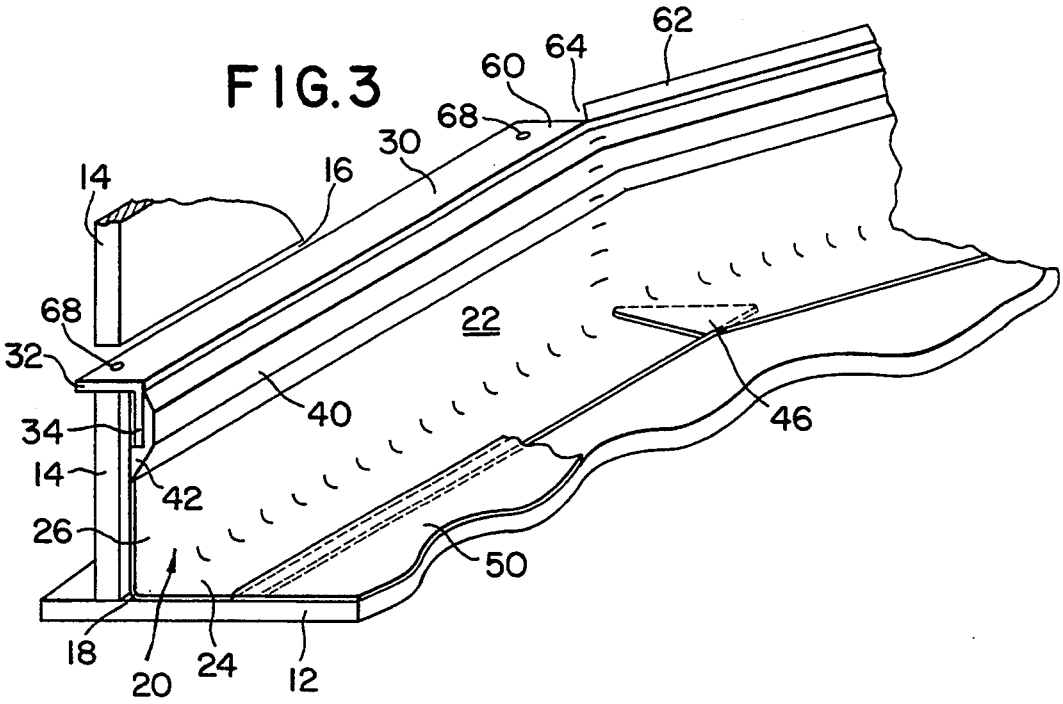

CORNER LOCK FOR LINING TANK BOTTOMS

BACKGROUND OF THE INVENTION

The present invention relates generally to seals for tank bottoms and more particularly to corner locks for efficient and effective installation of tank bottom seals.

In the construction and rehabilitation of flat bottom tanks with a vertical cylindrical shell, it is sometimes necessary or desirable to add a second, upper tank bottom above the first lower tank bottom. The lower tank bottom can be sealed to minimize leakage from the tank through perforations that may develop in the upper tank bottom. Further, the space between the upper and lower tank bottoms can be backfilled with soil, sand, gravel or concrete depending on the load bearing requirements of the tank bottom.

A material commonly used to line the lower bottom of the tanks is high density polyethylene (HDPE). It provides the desired sealing properties while having the durability to withstand construction worker foot-traffic and the impact of back-fill material. HDPE also provides enough flexibility in the seal to conform to irregular tank bottom surfaces during construction and back filling. It can also be installed during adverse weather conditions and no special tank surface preparation is necessary.

A number of liner installation techniques are in use which have satisfactory results but which have numerous quality assurance problems that are not immediately apparent since seal effectiveness may not be challenged until many years after installation.

One such technique uses sheets of HDPE on the tank bottom and prevents shifting of the sheets by using percussion pins to fix the sheet to the tank bottom. Obviously, such pins can damage the existing structure and any holes in the HDPE reduce its effectiveness as a seal. Epoxy can be used to cover the pin and adjacent HDPE. The effectiveness of the epoxy patching is unknown since experience indicates that some types of epoxy will not adhere well to HDPE. Thus, this technique can result in a perforated seal that must rely in part on concrete back-fill for effectiveness. Further, a flat seal such as this only covers the bottom of the tank which is unable to prevent run-off at the tank corners where the shell meets the tank bottom.

Another technique for lining tank bottoms uses flat sheets on the tank bottom in addition to a vertical component on the tank shell so that the seal can retain at least some fluid which may leak through the upper tank bottom. This second technique requires the welding of short studs around the tank shell. Vertical sheets of HDPE are secured to the studs using nails. Again, nail holes in the HDPE may or may not be effectively sealed using epoxy and further damage to the tank structure can result from the welding process. A disadvantage of using studs on the vertical walls is that the seal is spaced out from the tank shell where it is vulnerable to punctures. Yet another disadvantage in this techniques is that the corner where the vertical and horizontal pieces of HDPE meet must be sealed. Plastic welding techniques are well known and can be used, but it is difficult to effectively weld such a corner in the field.

A third technique is used which includes the use of a sealing paint on the vertical shell surfaces which can overlay the horizontal seal on the tank bottom. The primary drawback of this technique is that the corner seal is typically unsatisfactory since even minor shifting or movement in the horizontal sheet material can break the paint seal at the corner. Fiberglass may be similarly used to adhere to both the tank shell and the tank bottom, but this requires sandblasting of the tank surfaces and favorable weather conditions.

SUMMARY OF THE INVENTION

The present invention provides a number of advantages over prior tank liners and tank lining techniques. A tank liner in accordance with the present invention includes a flexible sheet material such as high density polyethylene (HDPE) having a horizontal portion bearing on the tank bottom, and a vertical portion extending up from the horizontal portion and adjacent to the tank shell, it also includes a rim joined to the vertical portion of the flexible sheet material and fixed to the tank shell. This type of seal provides an effective corner seal because it avoids the necessity of welding two sheets of seal material in the tank corners and provides a reliable reservoir for fluid that may leak onto the seal through the upper tank bottom. Further, the sheet material secured at the rim and not with nails that perforate the sheet.

The rim may be made of a piece of steel that is an angle in cross-section having vertical leg fixed to the vertical portion of the flexible sheet and a horizontal portion that is capable of engaging a horizontal slot in the tank shell. Horizontal slots in the shell are made to support the upper tank bottom in both retrofits and new construction. Thus, no damaging welding or nailing, or additional cutting need be done to secure the rim to the shell.

The liner may have the vertical portion of the flexible sheet interposed between the tank shell and the vertical leg of the rim angle. The vertical leg of the rim angle can define a number of holes, through which a connection can be made between the vertical portion of the flexible sheet and a cap positioned on the other side of the rim. This arrangement provides a secure connection between the flexible sheet and the rim and can be made off-site in a shop to ensure uniform quality.

The rim can be rolled to conform to the inside of a cylindrical tank shell. Further, the rim and flexible sheet can be made up of a number of segments that are contiguous around the tank shell. These segments can be prefabricated in a shop to form modular tank liner corner segments and then shipped to the tank site and installed end-to-end to form a continuous seal by butt-welding the joints together. These lap joints avoid the use of any epoxies or liquid sealers or gaskets at any location on the tank seal.

The present invention also relates to a method for lining a tank bottom including the steps of installing modular tank liner corner lock segments to define joints therebetween and to form a continuous corner seal around the tank corner, field sealing the joins, installing a horizontal sheet to bear on the tank bottom and to define a joint with the horizontal portion of the tank liner corner lock, and field sealing the joint between the horizontal sheet and the corner lock. This method requires no specially trained field personnel and provides a simple construction technique that assures a quality seal lining.

BRIEF DESCRIPTION OF THE DRAWINGS

FIG. 1 is a partial perspective view of a tank floor, tank shell, and arcuate tank liner in accordance with the present invention;

FIG. 2 is a partial perspective view of a rim angle with openings in the vertical leg;

FIG. 3 is a partial perspective view of a tank floor, tank shell, and tank liner made of straight segments;

DETAILED DESCRIPTION OF THE DRAWINGS

Figure 4:
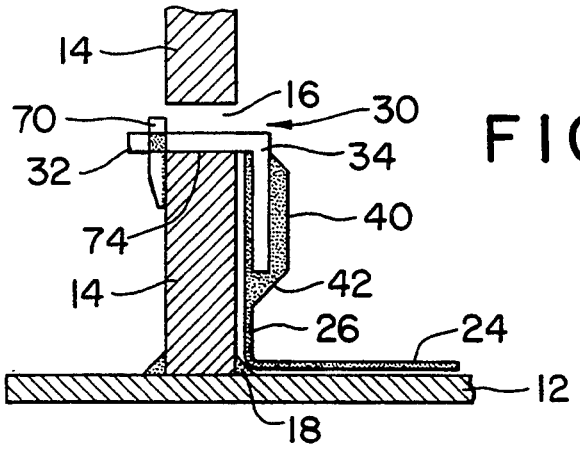
FIG. 4 is a partial cross-section of a tank floor, tank shell and corner detail in accordance with the present invention.

Illustrated in FIG. 1 is a portion of a tank 10 having a horizontal lower tank bottom 12 and a substantially vertical tank shell 14 extending upwardly from the tank bottom 12 and defining a horizontal slot 16. The junction of the tank bottom 12 and the tank shell 14 defines a corner 18. Although not completely illustrated, the tank shell 14 is cylindrical in shape and extends upward and may have a roof. The tank bottom 12 is substantially circular when viewed in plan.

It is to be understood that as used herein, and particularly in the claims, the use of the terms "tank", "tank shell", and "tank bottom" include any type of containment vessel having a bottom and a substantially vertical wall. These types of vessels include, but are not limited to, those made of steel and concrete.

A corner lock is indicated generally at 20 and includes a flexible sheet 22 having a horizontal portion 24 that bears on the tank bottom 12, and a vertical portion 26 that extends upwardly from the horizontal portion 24 adjacent to the tank shell 14. The flexible sheet is preferably made of eighty mil high density polyethylene (HDPE). This thickness of HDPE is flexible enough to provide resilience under construction and back filling loads. To bend eighty mil HDPE to the illustrated shape, it may be necessary to heat the sheet and then fold the HDPE to shape.

As can be seen in FIG. 1, the tank shell 14 is cylindrical in shape. To accommodate this shape, the rim 30 is rolled in an arc to conform to the shell 14. This is desirable because it prevents the flexible sheet 22 from being spaced away from the shell 14 where it is more susceptible to being punctured or otherwise damaged by workers or back fill.

Because the flexible sheet 22 has both vertical and horizontal components, it must be cut to forth a notch 46 where the horizontal portion 24 laps itself. This notch 46 may be shop-or field-welded.

Nevertheless, to minimize the waste involved with notches and material overlap it is desirable to limit the length of the flexible sheet horizontal portion 24 to a distance away from the corner 18 that will ensure an adequate corner seal and provide enough horizontal material to lap with the tank bottom seal. Typically this is at least twelve inches.

A rim 30 is provided to secure the flexible sheet 20 to the tank shell 14. The rim 30 is preferably made of steel, and it has a horizontal leg 32 and a vertical leg 34 extending downwardly from the horizontal leg 32. The horizontal leg 32 engages the tank shell 14 at slot 16 and simply rests on the lower lip of the slot 16. Rim 30 can be joined to tank shell 14 at any desired elevation above tank bottom 12.

As illustrated in FIG. 2, the vertical leg 34 of the rim 30 is preferably provided with a number of openings or slots 38 to enable the rim 30 to be fixed to the flexible sheet 22. This connection is most effectively made when the vertical portion 26 of flexible sheet 22 is interposed between the tank shell 14 and the vertical leg 34 of the flexible sheet 22. A cap 40 is positioned adjacent to the slots 38 in the rim 30 and the cap 40 and the flexible sheet vertical portion 26 are welded together through the slots 38. This provides a secure bond between the cap 40 and the flexible sheet 22 and it entraps the rim 30 to ensure a permanent connection- Together the rim and the flexible sheet 22, having a vertical and a horizontal component define the corner lock 20.

Cap 40 is preferably extrusion molded and provided with a lip 42 that seals the bottom of the rim angle vertical leg 34. In the event fluid should reach that level, none will be able to leak out between the rim and the vertical portion 26 of the flexible sheet 22. The lip 42 is welded directly to the flexible sheet 22 to ensure a good seal.

To line the remaining portion of the tank bottom 12, a number of flat sheets 50 are laid out and overlapped with the horizontal portion 24 of flexible sheet 22 where it can be field welded to complete the corner lock 20 and prevent shifting of the sheets during construction. It is preferable that the flat sheets be made of HDPE which is also the preferred material for the flexible corner sheet 22 to ensure a good bond between the two.

One aspect of the present invention is that the corner lock 20 having a rim 30 and flexible sheet 22 can be prefabricated modular segments that are either arc-shaped or straight line segments. Modular segments can be installed end-to-end to form a continuous corner lock around the tank 10. Once the corner lock 20 is installed, flat sheets 50 are laid out and welded to the flexible sheets 22.

FIG. 3 illustrates an alternative corner lock detail in which the angle-shaped rim 30 is made of straight segments 60 and 62 that are either two modular segments placed end-to-end to define a butt joint or can be formed from a single length of rim angle. To do this, it is necessary to notch 64 horizontal leg 32 of rim angle 30. This notch 64 allows vertical leg 34 of rim angle 30 to bend toward shell 14 for a tighter fit.

This bending of rim angle 30 can be completed in the field during installation of corner lock 20. Horizontal leg 32 of rim 30 is provided with spaced apart holes 68 that are accessible from the outside of shell 14. Pins or bars 70 (see FIG. 4) can then be driven into holes 68 to pull vertical leg 34 toward shell 14 and hold it securely during construction.

FIG. 4 also illustrates a cross-section of the corner lock 20 illustrated in FIGS. 1 and 3. It can be seen from FIG. 4 that air trapped beneath the tank liner during installation can escape when the back fill is added. This is possible because lower lip 74 of slot 16 is not smooth enough to provide an air-tight seal until a load is applied (see below). Thus, as back fill is added on top of the liner 20, entrapped air is forced outward toward the corner 18 and upward and out between the lower lip 66 of slot 16 and the horizontal leg 32 of rim angle 30.

Figure 5:
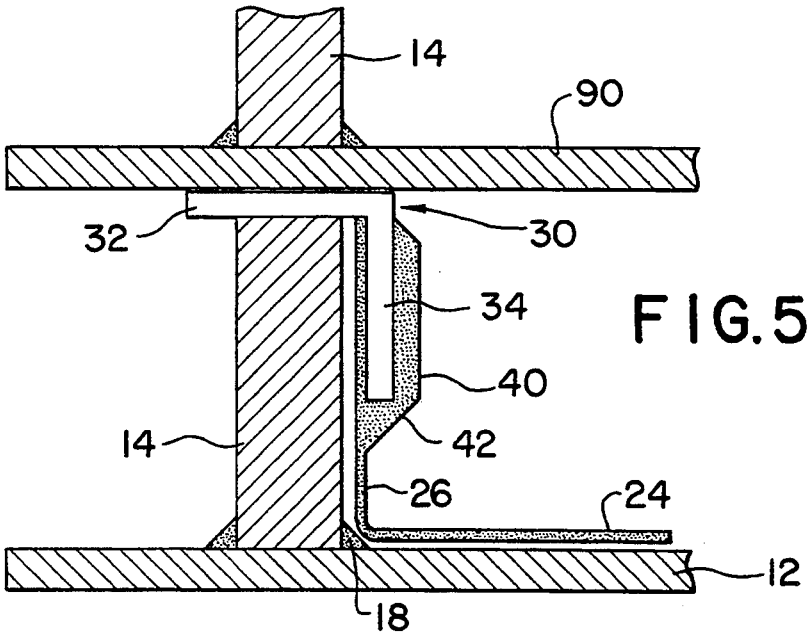
FIG. 5 is the partial cross-section of FIG. 3 and further including an upper tank floor.

FIG. 5 illustrates the cross-section of FIG. 4 with the addition of an upper tank bottom 90 that is installed after the tank seal is installed and back-filled. No gaskets are necessary between upper tank bottom 90 and rim 32 because leakage there will allow maintenance personnel to detect a leak in upper tank bottom 90 as opposed to undetectable leakage through lower tank bottom 12. Nevertheless, compliance with American Petroleum Institute Standards 650 and 653 may require welding of some or all of the structural elements or it may require silicone sealing of the joint to prevent outside elements from seeping into the tank 10.

In the case of concrete shells, rim 30 can be embedded in the concrete by installing it in the forms prior to placement of the concrete or it can be fastened to the concrete shell later using bolts or impact nails. When rim 30 is placed in concrete forms to become an integral part of shell 14, flexible sheet 22 can also be placed in the form and be ready for welding to horizontal sheet 50 as soon as the forms are stripped.

The foregoing detailed description has been given for clearness of understanding only, and no unnecessary limitations should be understood therefrom, as modifications will be obvious to those skilled in the art.

What is claimed is:

1. A liner for a tank that includes a horizontal tank bottom and a vertical tank shell extending upwardly from the tank bottom, the liner comprising:

a) a flexible sheet having a substantially horizontal portion bearing on at least a portion of the tank bottom, and a substantially vertical portion extending up from the horizontal portion adjacent to the tank shell;

b) a rim angle having a vertical leg defining a plurality of openings and a horizontal leg joined to the tank shell; and c) a cap made of the same material as the flexible sheet and positioned adjacent the vertical leg of the rim angle and the cap is welded to the vertical portion of the sheet through the openings in the vertical leg of the rim angle.

2. A liner for a tank that includes a horizontal tank bottom and a vertical tank shell extending upwardly from the tank bottom, the liner comprising:

a) a flexible sheet having a substantially horizontal portion bearing on at least a portion of the tank bottom, and a substantially vertical portion extending up from the horizontal portion adjacent to the tank shell; and b) a rim angle having a vertical leg fixed to the vertical portion of the flexible sheet, and a horizontal leg, the horizontal leg of the rim angle is inserted into a horizontal slot in the tank shell.

3. The liner of claim 1 in which:

the flexible sheet material is made of high density polyethylene.

4. The liner of claim 1 in which:

the rim is rolled to conform to the shape of the tank shell.

5. The liner of claim 1 in which:

the rim and flexible sheet material are fabricated in a plurality of segments contiguously joined inside the tank.

6. The liner of claim 1 and further comprising:

a horizontal sheet bearing on at least a portion of the tank bottom and fixed to the horizontal portion of the flexible sheet.

7. A liner for a tank that includes a horizontal tank bottom and a vertical tank shell extending upwardly from the tank bottom, the tank shell defining a horizontal slot, and the liner comprising:

a) flexible sheet having a substantially horizontal portion bearing on at least a portion of the tank bottom and a vertical portion extending upwardly from the horizontal portion adjacent to the tank shell;

b) a rim having a horizontal leg engaging the horizontal slot in the tank shell, and having a vertical leg extending downwardly from the horizontal leg and adjacent to the vertical portion of the flexible sheet, the vertical leg defining a plurality of openings; and c) a cap positioned adjacent the openings in the vertical leg of the rim angle, the cap being fixed to the vertical portion of the flexible sheet through the openings in the vertical leg of the rim angle.

8. The lines of claim 7 in which:

the flexible sheet and the cap are made of high density polyethylene.

9. The liner of claim 7 in which:

the rim is rolled to conform to the shape of the tank shell.

10. The liner of claim 7 in which:

the rim, flexible sheet material, and cap are fabricated in segments and contiguously joined inside the tank.

11. The liner of claim 7 and further comprising:

a horizontal sheet bearing on at least a portion of the tank bottom and fixed to the horizontal portion of the flexible sheet.

12. A modular tank liner corner lock segment for partially lining a tank having a horizontal tank bottom and a vertical tank shell extending upwardly from the tank bottom, and the tank shell defining a horizontal slot, the modular tank liner corner segment comprising:

a) a sheet having a substantially horizontal portion capable of bearing on at least a portion of the tank bottom, and a substantially vertical portion extending upwardly from the horizontal portion;

b) a rim having a vertical leg positioned adjacent the vertical portion of the sheet, the vertical leg defining a plurality of openings; and c) a cap positioned adjacent to at least one opening in the vertical leg of the rim and welded to the vertical portion of the sheet through the opening in the vertical leg of the rim.

13. A modular tank liner corner lock segment for partially lining a tank having a horizontal tank bottom and a vertical tank shell extending upwardly from the tank bottom, and the tank shell defining a horizontal slot, the modular tank liner corner segment comprising:

a) sheet having a substantially horizontal portion capable of bearing on at least a portion of the tank bottom, and a substantially vertical portion extending upwardly from the horizontal portion;

b) a rim having a vertical leg positioned adjacent the vertical portion of the sheet, the vertical leg defining a plurality of openings, and a horizontal leg extending outwardly from the vertical leg and the horizontal leg being capable of engaging the slot in the tank shell; and c) a cap positioned adjacent to at least one opening in the vertical leg of the rim and fixed to the vertical portion of the sheet through the opening in the vertical leg of the rim.

14. The modular tank liner corner segment of claim 12 in which:

the sheet is made of high density polyethylene.

15. The modular tank liner corner segment of claim 12 in which:

the rim is rolled to conform to the shape of the tank shell.

16. A method for lining a tank bottom where the tank includes a substantially horizontal tank bottom and a substantially endless vertical tank shell extending upwardly from the tank bottom to define a tank corner, the method comprising the steps of:

a) installing modular tank liner corner lock segments to define lap joints therebetween and to form a continuous corner lock around the tank corner, the tank liner corner segments each comprising a sheet having a horizontal portion bearing on at least a portion of the tank bottom and a vertical portion extending upwardly from the horizontal portion adjacent the tank shell, a rim having a vertical leg positioned adjacent the vertical portion of the sheet, the vertical leg defining a plurality of openings and a horizontal leg extending outwardly from the vertical leg and the horizontal leg being capable of engaging a slot in the tank shell, and a cap positioned adjacent to at least one opening in the vertical leg of the rim and welded to the vertical portion of the sheet through the opening in the vertical leg of the rim;

b) field sealing the lap joints between the modular tank liner corner segments;

c) installing a horizontal sheet to bear on at least a portion of the tank bottom to define a joint with a horizontal portion of the corner seal; and d) field sealing the joint between the horizontal sheet and the corner seal.

* * * * *